US009771818B2

(12) United States Patent
Budnick et al.

(10) Patent No.: US 9,771,818 B2
(45) Date of Patent: Sep. 26, 2017

(54) SEALS FOR A CIRCUMFERENTIAL STOP RING IN A TURBINE EXHAUST CASE

(71) Applicant: United Technologies Corporation, Hartford, CT (US)

(72) Inventors: Matthew Budnick, Tolland, CT (US); Conway Chuong, Manchester, CT (US); Jonathan A. Scott, Tolland, CT (US)

(73) Assignee: United Technologies Corporation, Hartford, CT (US)

( * ) Notice: Subject to any disclaimer, the term of this patent is extended or adjusted under 35 U.S.C. 154(b) by 1518 days.

(21) Appl. No.: 13/730,899

(22) Filed: Dec. 29, 2012

(65) Prior Publication Data

US 2014/0248128 A1 Sep. 4, 2014

(51) Int. Cl.

| | |
|---|---|
| ***F01D 11/00*** | (2006.01) |
| ***F01D 25/16*** | (2006.01) |
| ***F01D 25/24*** | (2006.01) |

(52) U.S. Cl.

CPC ..... *F01D 11/005* (2013.01); *F01D 25/162* (2013.01); *F01D 25/246* (2013.01)

(58) Field of Classification Search

CPC ..... F01D 9/04; F01D 11/003; F01D 11/005; F01D 25/162; F01D 25/243; F01D 25/246; F01D 25/28; F05D 2240/11

See application file for complete search history.

(56) References Cited

U.S. PATENT DOCUMENTS

| | | | |
|---|---|---|---|
| 2,124,108 | A | 7/1938 | Grece |
| 3,576,328 | A | 4/1971 | Vose |
| 3,842,595 | A | 10/1974 | Smith et al. |
| 3,970,319 | A | 7/1976 | Carroll et al. |
| 4,053,189 | A | 10/1977 | Novotny |
| 4,088,422 | A | 5/1978 | Martin |
| 4,114,248 | A | 9/1978 | Smith et al. |
| 4,183,539 | A | 1/1980 | French et al. |
| 4,184,689 | A | 1/1980 | Brodell et al. |
| 4,207,648 | A | 6/1980 | Sullivan et al. |
| 4,318,668 | A | 3/1982 | Chaplin et al. |
| 4,478,551 | A | 10/1984 | Honeycutt, Jr. et al. |
| 4,645,217 | A | 2/1987 | Honeycutt, Jr. et al. |
| 4,678,113 | A | 7/1987 | Bridges et al. |

(Continued)

FOREIGN PATENT DOCUMENTS

| | | |
|---|---|---|
| EP | 1373686 A1 | 1/2004 |

OTHER PUBLICATIONS

International Searching Authority, PCT Notification of Transmittal of the International Search Report and the Written Opinion, Oct. 27, 2014, 15 pages.

*Primary Examiner* — Craig Kim
*Assistant Examiner* — Danielle M Christensen
(74) *Attorney, Agent, or Firm* — Kinney & Lange, P.A.

(57) ABSTRACT

A turbine seal system comprises an annular structural frame, a circumferential ring, a fairing and a seal. The circumferential ring is joined to the annular structural frame. The fairing is disposed within the annular structural frame and is engaged with the circumferential ring to limit circumferential rotation of the fairing with respect to the annular structural frame. The seal extends between the fairing and the circumferential ring. In one embodiment, the structural component comprises a ring-strut-ring turbine exhaust case.

15 Claims, 5 Drawing Sheets

(56) References Cited

U.S. PATENT DOCUMENTS 4,723,577 A 2/1988 Wusterbarth
4,738,453 A 4/1988 Ide
4,756,536 A 7/1988 Belcher
4,793,772 A 12/1988 Zaehring et al.
4,798,514 A * 1/1989 Pask ..... F01D 9/023 415/115
4,920,742 A 5/1990 Nash et al.
4,987,736 A 1/1991 Ciokajlo et al.
4,993,918 A 2/1991 Myers et al.
5,031,922 A 7/1991 Heydrich
5,042,823 A 8/1991 Mackay et al.
5,071,138 A 12/1991 Mackay et al.
5,100,158 A 3/1992 Gardner
5,108,116 A 4/1992 Johnson et al.
5,118,120 A 6/1992 Drerup et al.
5,167,485 A 12/1992 Starkweather
5,169,159 A 12/1992 Pope et al.
5,174,584 A 12/1992 Lahrman
5,188,507 A 2/1993 Sweeney
5,211,541 A 5/1993 Fledderjohn et al.
5,236,302 A 8/1993 Weisgerber et al.
5,246,295 A 9/1993 Ide
5,271,220 A 12/1993 Holmes et al.
5,273,397 A 12/1993 Czachor et al.
5,332,358 A 7/1994 Hemmelgarn et al.
5,338,154 A 8/1994 Meade et al.
5,370,402 A 12/1994 Gardner et al.
5,385,409 A 1/1995 Ide
5,401,036 A 3/1995 Basu
5,423,659 A * 6/1995 Thompson ..... F01D 11/08 415/139
5,429,478 A 7/1995 Krizan et al.
5,474,305 A 12/1995 Flower
5,558,341 A 9/1996 McNickle et al.
5,632,493 A 5/1997 Gardner
5,668,421 A 9/1997 Gladish
5,746,573 A 5/1998 Junkin et al.
5,755,445 A 5/1998 Arora
5,911,400 A 6/1999 Niethammer et al.
5,961,279 A 10/1999 Ingistov
6,065,756 A 5/2000 Eignor et al.
6,079,945 A 6/2000 Wolfe et al.
6,196,550 B1 3/2001 Arora et al.
6,340,285 B1 1/2002 Gonyou et al.
6,343,912 B1 2/2002 Manteiga et al.
6,364,316 B1 4/2002 Arora
6,367,806 B1 4/2002 Turnquist et al.
6,439,841 B1 8/2002 Bosel
6,464,232 B1 10/2002 Marchi et al.
6,601,853 B2 8/2003 Inoue
6,619,030 B1 9/2003 Seda et al.
6,637,751 B2 10/2003 Aksit et al.
6,637,752 B2 10/2003 Aksit et al.
6,637,753 B2 10/2003 Mohammed-Fakir et al.
6,638,013 B2 10/2003 Nguyen et al.
6,652,229 B2 11/2003 Lu
6,736,401 B2 5/2004 Chung et al.
6,805,356 B2 10/2004 Inoue
6,811,154 B2 11/2004 Proctor et al.
6,884,023 B2 4/2005 Dube et al.
6,893,214 B2 5/2005 Alford et al.
6,935,631 B2 8/2005 Inoue
6,983,608 B2 1/2006 Allen, Jr. et al.
7,021,061 B2 4/2006 Tiemann
7,094,026 B2 8/2006 Coign et al.
7,163,206 B2 1/2007 Cross et al.
7,174,719 B2 2/2007 Kim
7,217,089 B2 5/2007 Durocher et al.
7,238,008 B2 7/2007 Bobo et al.
7,367,567 B2 5/2008 Farah et al.
7,371,044 B2 5/2008 Nereim
7,631,879 B2 12/2009 Diantonio
7,648,143 B2 1/2010 Davis et al.
7,665,957 B2 2/2010 Khanin et al.
7,677,044 B2 3/2010 Barbeln et al.
7,703,287 B2 4/2010 Haggerty et al.
7,735,833 B2 6/2010 Braun et al.
7,752,846 B2 7/2010 Boston et al.
7,798,768 B2 9/2010 Strain et al.
8,011,879 B2 9/2011 Guimbard et al.
8,051,663 B2 11/2011 Tuthill
8,052,382 B2 11/2011 Konter et al.
8,069,648 B2 12/2011 Snyder et al.
8,079,219 B2 12/2011 Johnson et al.
8,083,465 B2 12/2011 Herbst et al.
8,128,343 B2 3/2012 Schiavo et al.
8,128,349 B2 3/2012 Lutjen et al.
8,152,451 B2 4/2012 Manteiga et al.
8,221,071 B2 7/2012 Wojno et al.
8,226,365 B2 7/2012 Roush et al.
8,245,518 B2 8/2012 Durocher et al.
8,266,914 B2 9/2012 Hawie et al.
8,287,234 B1 10/2012 Liang
8,328,509 B2 12/2012 Gee et al.
8,366,383 B2 2/2013 Thibodeau et al.
8,382,432 B2 2/2013 Grissino et al.
8,388,309 B2 3/2013 Marra et al.
2003/0025274 A1 2/2003 Allan et al.
2003/0042682 A1 3/2003 Inoue
2003/0062684 A1 4/2003 Inoue
2003/0062685 A1 4/2003 Inoue
2005/0046113 A1 3/2005 Inoue
2005/0050898 A1 3/2005 Noda
2009/0129917 A1* 5/2009 Hazevis ..... F01D 11/005 415/173.1
2010/0129207 A1 5/2010 Mokulys et al.
2010/0132371 A1 6/2010 Durocher et al.
2010/0132374 A1 6/2010 Manteiga et al.
2010/0132377 A1 6/2010 Durocher et al.
2010/0251721 A1 10/2010 Morrison et al.
2010/0307165 A1 12/2010 Wong et al.
2011/0000223 A1 1/2011 Russberg
2011/0079019 A1 4/2011 Durocher et al.
2011/0081237 A1 4/2011 Durocher et al.
2011/0189009 A1* 8/2011 Shapiro ..... F01D 25/246 415/209.3
2011/0214433 A1 9/2011 Feindel et al.
2011/0233876 A1 9/2011 Bergman et al.
2011/0262277 A1 10/2011 Sjoqvist et al.
2012/0111023 A1 5/2012 Sjoqvist et al.
2012/0163964 A1 6/2012 Chuong et al.
2013/0039747 A1 2/2013 Heidingsfelder et al.
2013/0058764 A1 3/2013 Dillard et al.

* cited by examiner

SEALS FOR A CIRCUMFERENTIAL STOP RING IN A TURBINE EXHAUST CASE

BACKGROUND

The present disclosure relates generally to gas turbine engine exhaust cases. More particularly, the present disclosure relates to mounting rings for ring-strut-ring structures.

Turbine Exhaust Cases (TEC) typically comprise structural frames that support the very aft end of a gas turbine engine. In aircraft applications, the TEC can be utilized to mount the engine to the aircraft airframe. In industrial gas turbine applications, the TEC can be utilized to couple the gas turbine engine to an electrical generator. A typical TEC comprises an outer ring that couples to the outer diameter case of the low pressure turbine, an inner ring that surrounds the engine centerline so as to support shafting in the engine, and a plurality of struts connecting the inner and outer rings. As such, the TEC is typically subject to various types of loading, thereby requiring the TEC to be structurally strong and rigid. Due to the placement of the TEC within the hot gas stream exhausted from a combustor of the gas turbine engine, it is typically desirable to shield the TEC structural frame with a fairing that is able to withstand direct impingement of the hot gases. The fairing additionally takes on a ring-strut-ring configuration wherein the struts are hollow to surround the frame struts. The structural frame and the fairing can each be made of materials optimized for their respective functions.

When mounting the TEC to other structural components of a gas turbine engine, such as a casing for a power turbine of an electrical generator, it is necessary to seal the gas path. Seals are used to prevent leakage of exhaust gas from the gas path, which reduces efficiency of the power turbine, and to prevent cooling air from entering the gas path, which reduces efficiency of the gas turbine engine. It is therefore desirable to seal, for example, between the fairing and the TEC, as well as between the TEC and the power turbine. However, due to the specific geometries of these various components, it is sometimes necessary to seal across lengthy distances. Finger seals are typically used in such circumstances. In general, a finger seal becomes more inefficient as the gap over which it seals grows. Furthermore, the finger seal can become fatigued if it repeatedly deflects over a long distance. There is, therefore, a need for improved sealing arrangements between structural components in gas turbine engines.

SUMMARY

The present disclosure is directed to a seal system for a gas turbine engine. The seal system comprises an annular structural frame, a circumferential ring, a fairing and a seal. The circumferential ring is joined to the annular structural frame. The fairing is disposed within the annular structural frame and is engaged with the circumferential ring to limit circumferential rotation of the fairing with respect to the annular structural frame. The seal extends between the fairing and the circumferential ring. In one embodiment, the structural component comprises a ring-strut-ring turbine exhaust case.

BRIEF DESCRIPTION OF THE DRAWINGS

Various features will become apparent to those skilled in the art from the following detailed description of the disclosed non-limiting embodiment. The exemplary drawings that accompany the detailed description can be briefly described as follows.

DETAILED DESCRIPTION

Figure 1:
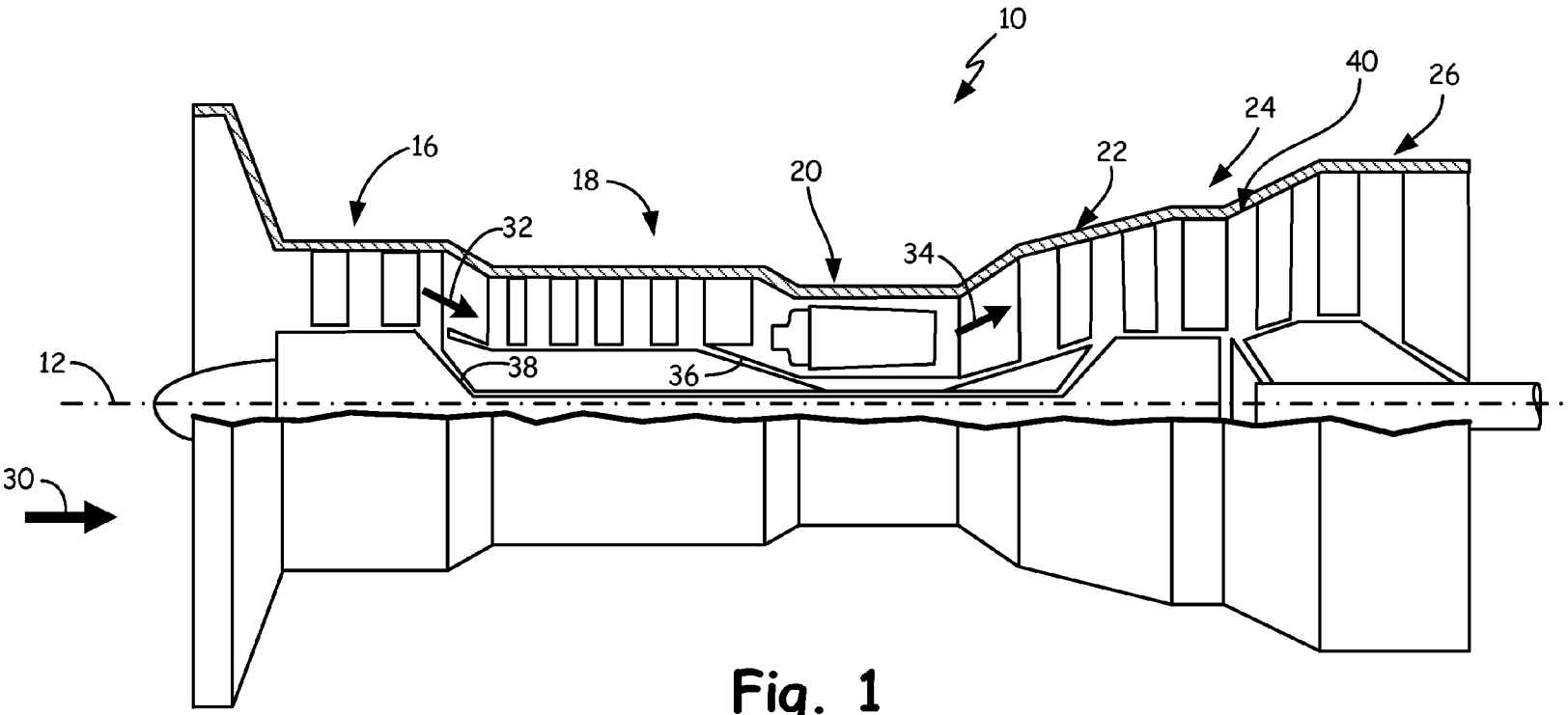
FIG. 1 is a side sectional schematic view of an industrial gas turbine engine having a turbine exhaust case.

FIG. 1 is a side partial sectional schematic view of gas turbine engine 10. In the illustrated embodiment, gas turbine engine 10 is an industrial gas turbine engine circumferentially disposed about a central, longitudinal axis or axial engine centerline axis 12 as illustrated in FIG. 1. Gas turbine engine 10 includes, in series order from front to rear, low pressure compressor section 16, high pressure compressor section 18, combustor section 20, high pressure turbine section 22, and low pressure turbine section 24. In some embodiments, power turbine section 26 is a free turbine section disposed aft of the low pressure turbine 24.

Low and high pressure compressor sections 16 and 18 pressurize incoming ambient air 30 to produce pressurized air 32. Fuel mixes with pressurized air 32 in combustor section 20, where it is burned. Once burned, combustion gases 34 expand through high and low pressure turbine sections 22 and 24 and through power turbine section 26. High and low pressure turbine sections 22 and 24 drive high and low pressure rotor shafts 36 and 38 respectively, which rotate in response to flow of combustion gases 34 and thus rotate the attached high and low pressure compressor sections 18 and 16. Power turbine section 26 may, for example, drive an electrical generator, pump, or gearbox (not shown).

Low Pressure Turbine Exhaust Case (LPTEC) 40 is positioned between low pressure turbine section 24 and power turbine section 26. LPTEC 40 defines a flow path for gas exhausted from low pressure turbine section 24 that is conveyed to power turbine 26. LPTEC 40 also provides structural support for gas turbine engine 10 so as to provide a coupling point for power turbine section 26. LPTEC 40 is therefore rigid and structurally strong. A sealing arrangement is provided between LPTEC 40 and power turbine section 26.

It is understood that FIG. 1 provides an overview of the various sections and operation of an industrial gas turbine engine. It will become apparent to those skilled in the art that the present application is applicable to all types of gas turbine engines, including those with aerospace applications. Similarly, although the present disclosure is described with reference to sealing arrangements for LPTEC 40, the present invention is applicable to other components of gas turbine engines, such as intermediate cases, mid-turbine frames and the like.

Figure 2A:
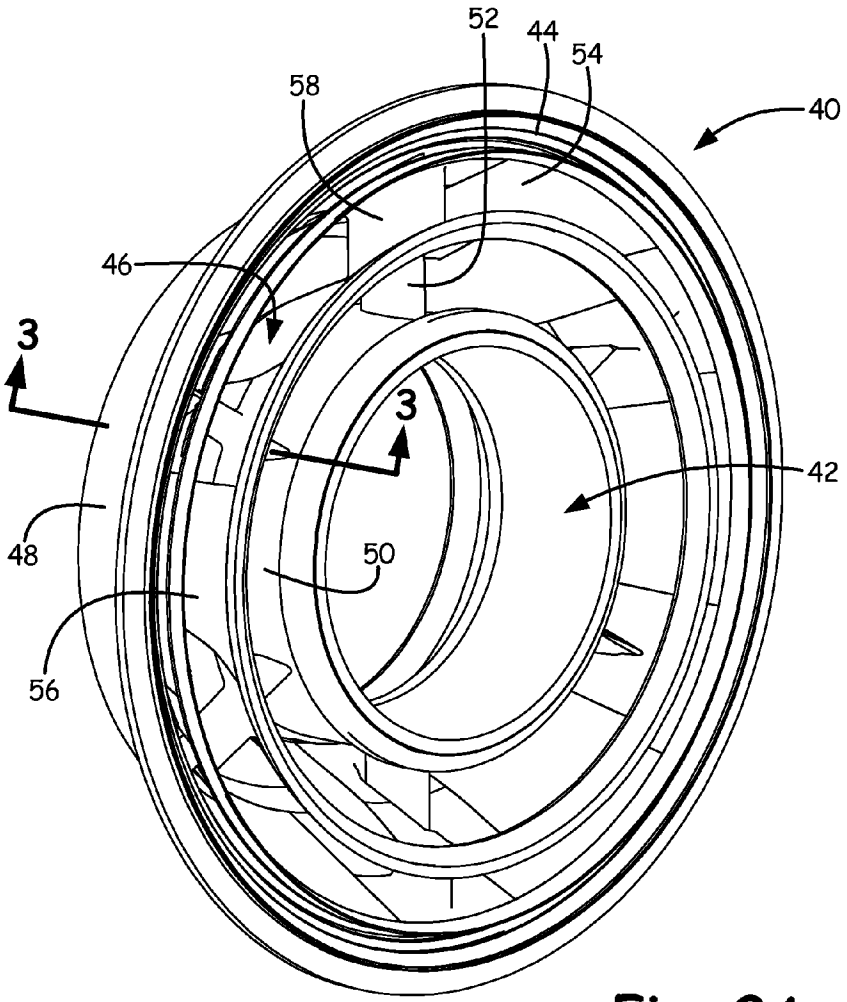
FIG. 2A is a perspective view of a turbine exhaust case in which a ring-strut-ring fairing is assembled with a ring-strut-ring frame.
Figure 2B:
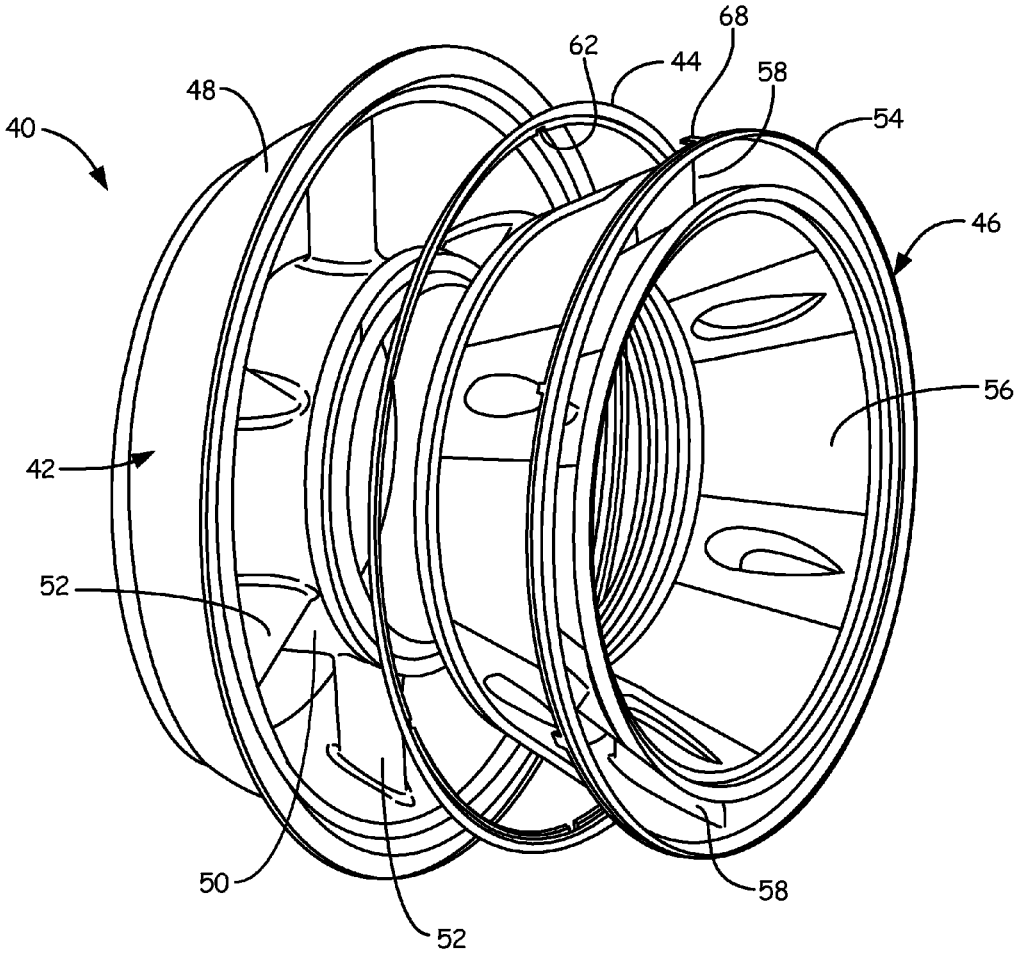
FIG. 2B is an exploded view of the turbine exhaust case of FIG. 2A showing the frame, the fairing and a circumferential stop ring.

FIG. 2A shows a perspective view of Low Pressure Turbine Exhaust Case (LPTEC) 40, which includes frame 42, annular mount 44, and fairing 46. FIG. 2B, which is discussed concurrently with FIG. 2A, shows an exploded view of LPTEC 40 showing annular mount 44 disposed between fairing 46 and frame 42. Frame 42 includes outer ring 48, inner ring 50, and struts 52. Fairing 46 includes outer ring 54, inner ring 56, and vanes 58.

Frame 42 comprises a ring-strut-ring structure that defines a gas path between outer ring 48 and inner ring 50. Fairing 46 also comprises a ring-strut-ring structure that is mounted within frame 42 to line the gas path and protect frame 42 from high temperature exposure. In one embodiment, fairing 46 is built around frame 42, and in another embodiment, frame 42 is built within fairing 46.

Frame 42 comprises a stator component of gas turbine engine 10 (FIG. 1) that is typically mounted between low pressure turbine section 24 and power turbine section 26. In the embodiment shown, outer ring 48 of frame 42 is conically shaped, while inner ring 50 is cylindrically shaped. Outer ring 48 is connected to inner ring 50 via struts 52. Outer ring 48, inner ring 50 and struts 52 form a portion of the gas flow path through gas turbine engine 10 (FIG. 1). Specifically, outer ring 48 and inner ring 50 define the outer and inner radial boundaries of an annular flow path between low pressure turbine section 24 and power turbine section 26 (FIG. 1), while struts 52 intermittently interrupt the annular flow path.

Fairing 46 is adapted to be disposed within frame 42 between outer ring 48 and inner ring 50. Outer ring 54 and inner ring 56 of fairing 46 have generally conical shapes, and are connected to each other by vanes 58, which act as struts to join rings 54 and 56. Outer ring 54, inner ring 56, and vanes 58, form a liner for the portion of the gas flow path through frame 42. Specifically, vanes 58 encase struts 52, while outer ring 54 and inner ring 56 line inward facing surfaces of outer ring 48 and inner ring 50, respectively.

Annular mount 44 is interposed between frame 42 and fairing 46 and is configured to prevent circumferential rotation of fairing 46 within frame 42. Annular mount 44 is adapted to be affixed to an axial end of outer ring 48. However, in other embodiments annular mount 44 can be affixed to inner ring 50 or to an intermediate portion of outer ring 48 that is not at or adjacent an axial end thereof. Annular mount 44 is illustrated as a crenellated, full-ring that is adapted to be attached to frame 42. Annular mount 44 comprises a circumferential stop ring. However, in other embodiments stop ring 44 may be segmented and comprise less than a full ring. Fairing 46 engages annular mount 44 when installed within frame 42. As will be discussed subsequently with reference to FIGS. 3 and 4, fairing 46 and stop ring 44 have mating anti-deflection features, such as slots 62 and lugs 68, that engage each other to prevent circumferential movement of fairing 46 relative to the frame 42. Specifically, lugs 68 extend axially into slots 62 to prevent circumferential rotation of fairing 46, while permitting radial and axial movement of fairing 46 relative to frame 42.

Figure 3:
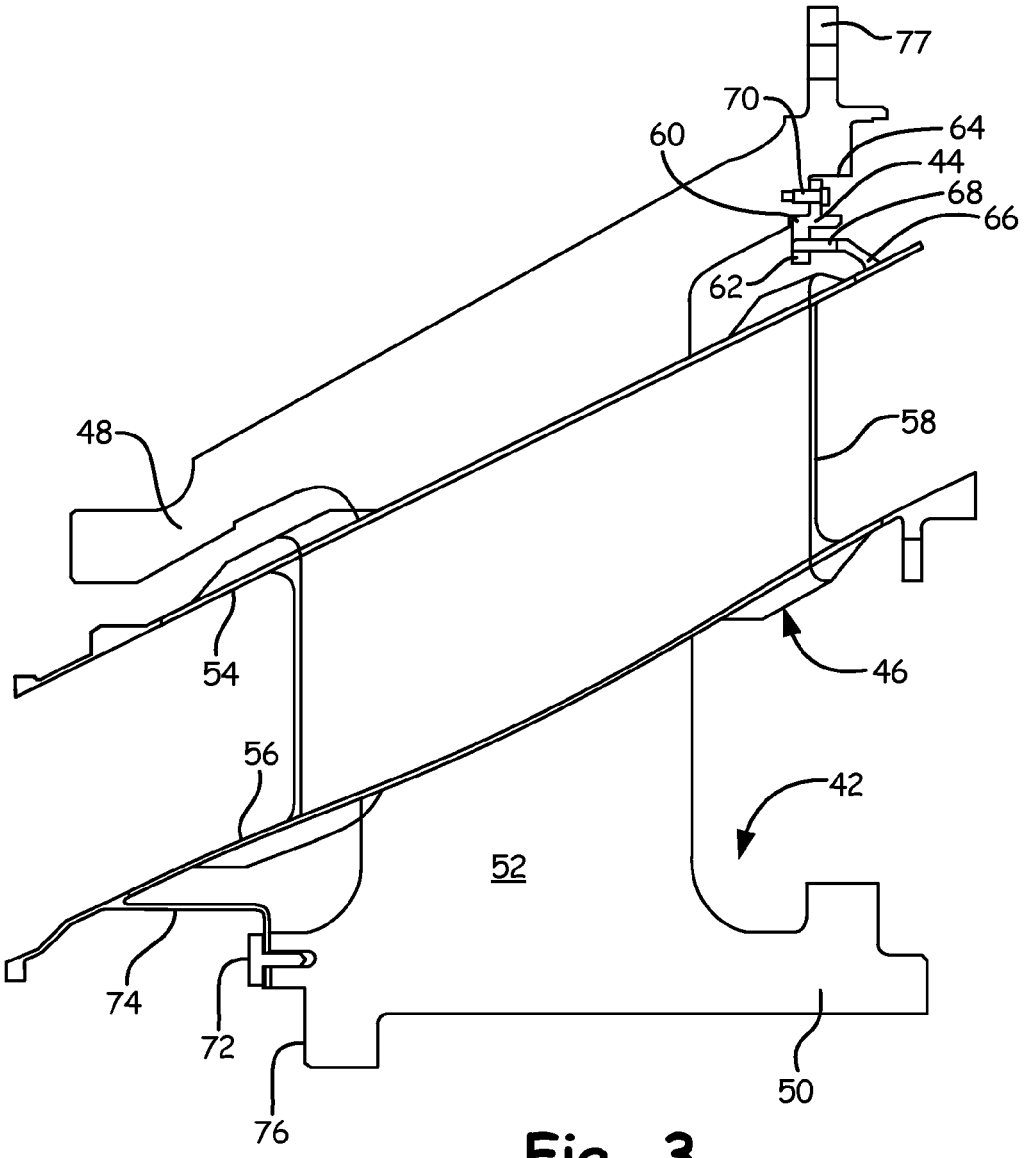
FIG. 3 is a cross-sectional view of the turbine exhaust case of FIG. 2A showing the circumferential stop ring linking the fairing to the frame.

FIG. 3 shows a cross-section of LPTEC 40 (viewing the section labeled as 3-3 in FIG. 2A) having fairing 46 installed within frame 42 utilizing annular mount 44, which includes anti-rotation flange 60 and lugs 62. Frame 42 includes outer ring 48, inner ring 50, strut 52 and counterbore 64. Fairing 46 includes outer ring 54, inner ring 56 and vane 58. Outer ring 54 includes anti-rotation flange 66 with slots 68. LPTEC 40 further comprises fasteners 70, fasteners 72 and mount ring 74.

Frame 42 comprises a structural, ring-strut-ring body wherein strut 52 is connected to outer ring 48 and inner ring 50. As mentioned, outer ring 48 and inner ring 50 define a portion of a flow path for gas exiting gas turbine engine 10 (FIG. 1). Frame 42 also includes other features, such as land 76 and flange 77, to permit frame 42 to be mounted to components of gas turbine engine 10 (FIG. 1), such as low pressure turbine section 24, power turbine section 26 or an exhaust nozzle. Fairing 46 comprises a thin-walled, ring-strut-ring structure that lines the flow path through frame 42. Specifically, outer ring 54 and inner ring 56 define the boundaries of an annular flow path. Vanes 58 intermittently interrupt the annular flow path to protect struts 52 of frame 42.

Mount ring 74 extends from inner ring 56 of fairing 46 and engages an axial end of inner ring 50 of frame 42. Mount ring 74 is connected via second fasteners 72 (only one is shown in FIG. 3). Fasteners 72 provide for axial, radial, and circumferential constraint of the axially forward portion of fairing 46 relative to frame 42. Thus, fairing 46 has a fixed connection (i.e., is radially, axially, and circumferentially constrained relative to the frame 42) to frame 42 at a first location.

Fairing 46 has a floating connection (i.e. has axial and radial degrees of freedom) to frame 42 at a second connection through engagement of flange 66 with annular mount 44. Annular mount 44 is attached to an axial end of outer ring 48 by fasteners 70 (only one is shown in FIG. 3). Outer ring 54 of fairing 46 includes flange 66 that engages flange 60 of annular mount 44. Flanges 66 and 60 are castellated to form mating arrays of circumferential slots and lugs. In particular, lugs 68 (only one in shown in FIG. 3) of flange 66 mate with slots 62 (only one in shown in FIG. 3) of flange 60, but allow fairing 46 to move both radially and axially (although only a limited amount) relative to frame 42. Slots 62 are connected to and extend generally radially outward into flange 60. Lugs 68 are connected to and extend generally axially forward from flange 66. Flanges 66 and 60 act to constrain fairing 46 from circumferential movement relative to frame 42 and annular mount 44. Flanges 66 and 60 allow for axial and radial thermal growth and vibration dampening, as needed, to achieve desired component life. Flanges 66 and 60 do not over-constrain fairing 46 since annular mount 44 protects only against circumferential movement of fairing 46 relative to frame 42. In the present invention, annular mount 44 includes seal engagement features, such as lands and backing plates, that facilitate coupling and engagement with sealing members, such as finger seals, W-seals and C-seals.

Figure 4:
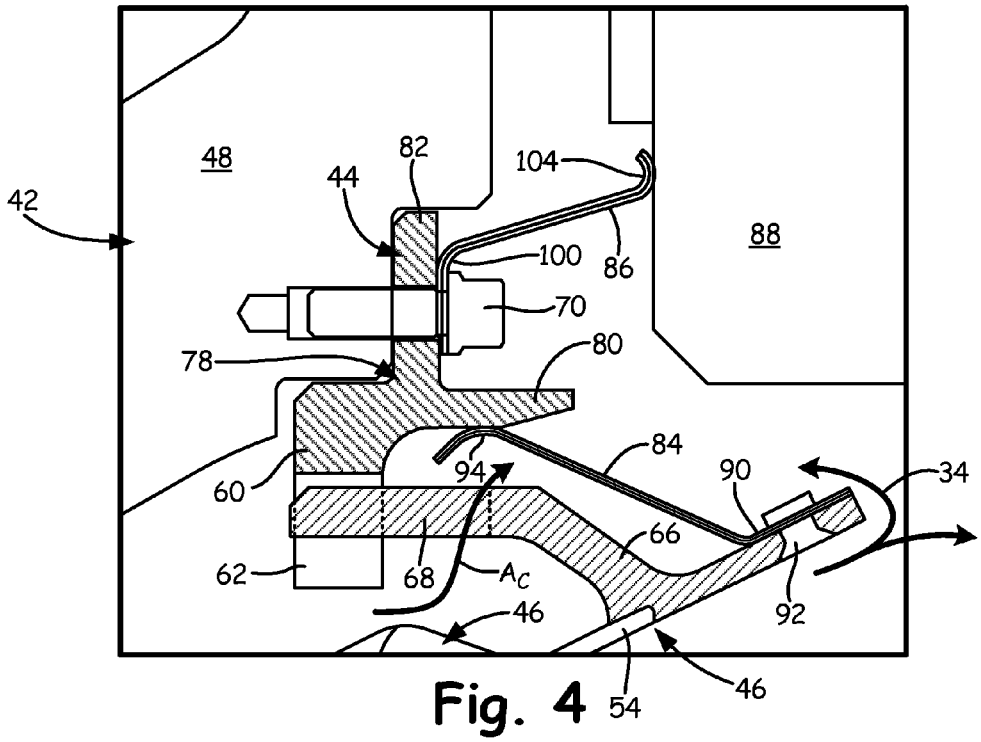
FIG. 4 is a cross-sectional view of a first embodiment of a turbine exhaust case sealing arrangement utilizing a circumferential stop ring with an inner diameter seal land and a backing plate.

FIG. 4 is a cross-sectional view of a first embodiment of a sealing arrangement for LPTEC 40 utilizing annular mount 44. In the embodiment of FIG. 4, annular mount 44 includes ring body 78, which forms anti-rotation flange 60, inner diameter seal land 80 and backing plate 82. Annular mount 44 engages with finger seal 84 to seal against fairing 46, and engages with finger seal 86 to seal against power turbine case 88. Power turbine case 88 comprises a stationary component of power turbine section 26 (FIG. 1), such as a structural frame that joins to flange 77 (FIG. 3) of LPTEC frame 42. Combustion gases 34 (FIG. 1) flow through fairing 46 and into power turbine case 88. Cooling air 89 is directed between frame 42 and fairing 46 to cool, for example, struts 52.

Ring body 78 of annular mount 44 comprises a full-ring annular body. Backing plate 82 comprises a full-ring projection, or flange, that extends radially outward from ring body 78. Backing plate 82 includes a plurality of holes to permit mounting of stop ring 44 to frame 42 using fasteners 70. Seal land 80 comprises a full-ring projection, or flange, that extends axially aftward from ring body 78. Anti-rotation flange 60 comprises a circumferential projection that extends radially inward from ring body 78. Anti-rotation flange 60 is crenellated so as to provide a plurality of spaced slots 62. As discussed previously, anti-rotation flange 66 of fairing 46 includes a plurality of axially extending lugs 68 that extend into slots 62 to inhibit circumferential rotation of fairing 46 within frame 42. Lugs 68 and slots 62 therefore comprise means for inhibiting circumferential rotation of fairing 46 within frame 42.

Finger seal 84 comprises a full-ring body with intermittent slots forming fingers, and includes first end 90 that is anchored to outer ring 54 of fairing 46, such as via rivet 92, and second end 94 that is biased against seal land 80. In other embodiments finger seal 84 may be comprised of a plurality of arcuate segments that are independently coupled to fairing 46. Finger seal 84 is thin so as to provide a degree of flexibility, thereby enabling finger seal 84 to be deflected when engaged with seal land 80 when fairing 46 is installed within frame 42.

Finger seal 86 comprises a full-ring body with intermittent slots forming fingers, and includes first end 100 that is anchored to seal land 82 of stop ring 44, such as via fastener 70, and second end 104 that is biased against power turbine case 88. In other embodiments finger seal 86 may be comprised of a plurality of arcuate segments that are independently coupled to stop ring 44. Finger seal 86 is thin so as to provide a degree of flexibility, thereby enabling finger seal 86 to be deflected when engaged with power turbine case 88 when power turbine section 26 (FIG. 1) is coupled to frame 42.

Finger seals 84 and 86 are fabricated from any suitable material that is capable of withstanding elevated temperatures, such as metal alloys commonly used in the gas turbine industry. In other embodiments of the invention, finger seals 84 and 86 may be replaced with ring-like W-seals or ring-like C-seals, as are known in the art.

Combustion gases 34 are at a higher pressure than ambient air and thus have a tendency to leak from the gas path between frame 42 and power turbine case 88. Finger seal 86 extends across a gap between annular mount 44 and power turbine case 88 to inhibit combustion gases 34 from leaving the gas path and bypassing power turbine 26. As such, a greater percentage of the whole of combustion gases 34 flow into power turbine 26, thereby increasing the efficiency of power turbine 26 and gas turbine engine 10. Cooling air 89 is at a higher pressure than combustion gases 34 and thus has a tendency to migrate out of LPTEC 40. Finger seal 84 extends across a gap between annular mount 44 and fairing 46 to inhibit cooling air 89 from leaving internal spaces within LPTEC 40. As such, a greater percentage of the whole of cooling air 89 is used for cooling purposes, thereby increasing the efficiency of systems that generate cooling air 89, such as low pressure compressor section 18.

Annular mount 44 circumscribes the entire flow path of combustion gases 34 between the juncture of frame 42 and power turbine case 88. Likewise, annular mount 44 circumscribes the entire interface between frame 42 and fairing 46. Annular mount 44 is mounted within LPTEC 40 at the juncture of the flows of combustion gases 34 and cooling air 89. Thus, annular mount 44 provides a convenient and accessible position for providing finger seals 84 and 86, thereby improving performance, and facilitating removal, repair and replacement of the seals. Specifically, annular mount 44 provides a platform or base against which finger seals 84 and 86 can be configured to engage. Ring body 78 positions seal land 80 and backing plate 82 to allow for engagement with finger seals 84 and 86, respectively, while accommodating placement and function of anti-rotation flange 60.

Figure 5:
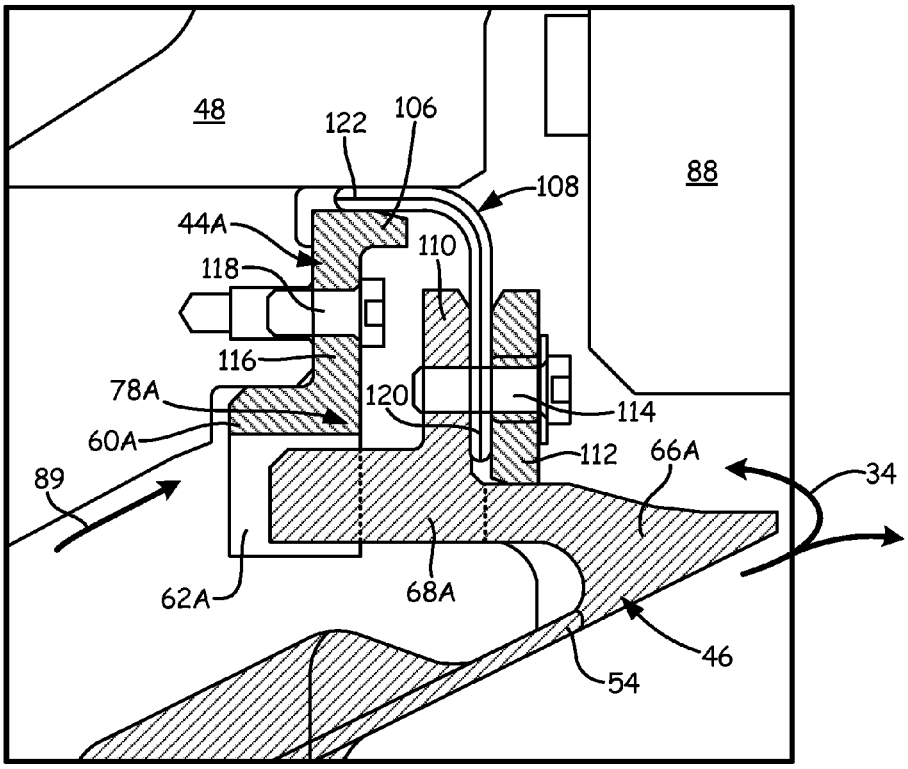
FIG. 5 is a cross-sectional view of a second embodiment of a turbine exhaust case sealing arrangement utilizing a circumferential stop ring with an outer diameter seal land.

FIG. 5 is a cross-sectional view of a second embodiment of a sealing arrangement for LPTEC 40 utilizing annular mount 44A. In the embodiment of FIG. 5, annular mount 44A includes outer diameter seal land 106. Annular mount 44A engages with L-seal 108 to seal between fairing 46 and frame 42. L-seal 108 is secured to fairing 46 between flange 110 of outer ring 54 and attachment ring 112 via fastener 114. Combustion gases 34 (FIG. 1) flow through fairing 46 and into power turbine case 88. Cooling air 89 is directed between frame 42 and fairing 46 to cool, for example, struts 52. Elements of FIG. 5 that are similar as in FIG. 4 include like numbering with an "A" designation.

Ring body 78A of annular mount 44A comprises a full-ring annular body. Mounting plate 116 comprises a full-ring projection, or flange, that extends radially outward from ring body 78A. Mounting plate 116 includes a plurality of holes to permit mounting of stop ring 44A to frame 42 using fasteners 118. Seal land 106 comprises a full-ring projection, or flange, that extends axially aftward from mounting plate 116. Anti-rotation flange 60A comprises a circumferential projection that extends radially inward from ring body 78A. Anti-rotation flange 60A is crenellated so as to provide a plurality of spaced slots 62A. As discussed previously, anti-rotation flange 66A of fairing 46 includes a plurality of axially extending lugs 68A that extend into slots 62A to inhibit circumferential rotation of fairing 46 within frame 42.

L-seal seal 108 comprises a full-ring body with intermittent slots forming fingers, and includes first end 120 that is anchored to outer ring 54 of fairing 46, such as via fastener 114, and second end 122 that is pinned between seal land 106 and frame 42. In other embodiments L-seal 108 may be comprised of a plurality of arcuate segments that are independently coupled to fairing 46. L-seal 108 is thin so as to provide a degree of flexibility, thereby enabling L-seal 108 to be deflected when attachment ring 112 engages with flange 110. L-seal 108 is fabricated from any suitable material that is capable of withstanding elevated temperatures, such as metal alloys commonly used in the gas turbine industry. In other embodiments of the invention, L-seal 108 may be replaced with ring-like finger seals, W-seals or ring-like C-seals, as are known in the art.

Cooling air 89 is at a higher pressure than combustion gases 34 and thus has a tendency to migrate out of LPTEC 40. Similarly, combustion gases 34 are at a higher pressure than ambient air and thus have a tendency to leak from the gas path between frame 42 and power turbine case 88. L-seal 108 extends across a gap between annular mount 44A and fairing 46 to inhibit cooling air 89 from leaving internal spaces within LPTEC 40, and to prevent combustion gases 34 from entering internal spaces within LPTEC 40, thereby improving the efficiency of gas turbine engine 10 and sub-systems therein.

Discussion of Possible Embodiments

The following are non-exclusive descriptions of possible embodiments of the present invention.

A turbine seal system comprises an annular structural frame, a circumferential ring joined to the annular structural frame, a fairing disposed within the annular structural frame and engaged with the circumferential ring to limit circumferential rotation of the fairing with respect to the annular structural frame, and a seal extending between the fairing and the circumferential ring.

The turbine seal system of the preceding paragraph can optionally include, additionally and/or alternatively, any one or more of the following features, configurations and/or additional components:

A circumferential ring comprising an annular ring body engaged with the annular structural frame, a circumferential stop projecting radially from the annular ring body to engage the fairing, and a seal land projecting axially from the annular ring body to engage the seal.

A circumferential stop comprising slots extending radially inward from the annular ring body.

A fairing including lugs extending axially so as to be interposed with the slots.

A backing plate extending radially from the annular ring body, and a plurality of bolt holes extending through the backing plate.

Seal lands projecting axially aftward from an inner diameter of the annular ring body.

Seal land projecting axially aftward from an outer diameter of the annular ring body.

A seal comprising a first end coupled to the fairing, and a second end biased against the seal land.

A second seal comprising a first end coupled to the annular ring body, and a second end extending aftward so as to be configured to engage a structural component joined to the annular structural frame.

A seal comprising a first end coupled to the fairing, and a second end secured between the seal land and the annular structural frame.

A coupling flange extending from the fairing, and a seal ring joined to the coupling flange, wherein the first end of the seal is secured between the coupling flange and the seal ring.

A means for inhibiting circumferential rotation of the fairing within the frame.

A gas turbine engine structural system comprises a frame comprising an outer ring, an inner ring, and a plurality of struts joining the outer ring and the inner ring; a fairing coupled to the plurality of struts between the outer ring and the inner ring; a circumferential stop ring joined to the outer ring and engaged with the fairing, the circumferential stop ring including a seal land; and a seal extending between the fairing and the seal land.

The gas turbine engine structural system of the preceding paragraph can optionally include, additionally and/or alternatively, any one or more of the following features, configurations and/or additional components:

A circumferential stop ring joined to the outer ring at a bolted connection.

A seal land projecting axially aftward from the circumferential stop ring radially inward of the bolted connection.

A seal comprising a first end coupled to the fairing, and a second end biased against the seal land.

A seal land projecting axially aftward from the circumferential stop ring radially outward of the bolted connection.

A seal comprising a first end coupled to the fairing, and a second end secured between the seal land and the outer ring.

A circumferential stop ring for a gas turbine engine structural member and fairing comprises an annular ring body for joining to the structural member, a plurality of circumferential stop lugs projecting radially inward from the annular ring body for engaging a fairing, and a seal land projecting axially aftward from the annular ring body to provide a seal surface.

The circumferential stop ring for a gas turbine engine structural member and fairing of the preceding paragraph can optionally include, additionally and/or alternatively, any one or more of the following features, configurations and/or additional components:

A plurality of bolt holes extending through the annular ring body.

A seal land positioned radially inward of the plurality of bolt holes.

A seal land positioned radially outward of the plurality of bolt holes.

It is understood that use of relative positional terms such as "forward," "aft," "upper," "lower," "above," "below," and the like are with reference to the normal operational attitude of the turbine and should not be considered otherwise limiting.

It is understood that like reference numerals identify corresponding or similar elements throughout the several drawings. It is understood that although a particular component arrangement is disclosed in the illustrated embodiment, other arrangements will benefit herefrom.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is understood that within the scope of the appended claims, the disclosure may be practiced other than as specifically described. For that reason the appended claims should be studied to determine true scope and content.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A turbine seal system comprising:

an annular structural frame;

a circumferential ring joined to the annular structural frame, the circumferential ring comprising:

an annular ring body engaged with the annular structural frame;

a circumferential stop comprising slots projecting radially inward from the annular ring body; and a seal land projecting axially from the annular ring body;

a fairing disposed within the annular structural frame and engaged with the circumferential stop to limit circumferential rotation of the fairing with respect to the annular structural frame, wherein the fairing includes lugs extending axially so as to be interposed with the slots; and a seal extending between the fairing and the circumferential ring to engage the seal land.

2. The turbine seal system of claim 1 and further comprising:

a backing plate extending radially from the annular ring body; and a plurality of bolt holes extending through the backing plate.

3. The turbine seal system of claim 1 wherein the seal land projects axially aftward from an inner diameter of the annular ring body.

4. The turbine seal system of claim 1 wherein the seal land projects axially aftward from an outer diameter of the annular ring body.

5. The turbine seal system of claim 1 wherein the seal comprises:

a first end coupled to the fairing; and a second end biased against the seal land.

6. The turbine seal system of claim 5 and further comprising:

a second seal comprising:

a first end coupled to the annular ring body; and a second end extending aftward so as to be configured to engage a structural component joined to the annular structural frame.

7. The turbine seal system of claim 1 wherein the seal comprises:

a first end coupled to the fairing; and a second end secured between the seal land and the annular structural frame.

8. The turbine seal system of claim 7 and further comprising:

a coupling flange extending from the fairing; and an attachment ring joined to the coupling flange;

wherein the first end of the seal is secured between the coupling flange and the attachment ring.

9. The turbine seal system of claim 1 and further comprising means for inhibiting circumferential rotation of the fairing within the frame.

10. A circumferential stop ring for a gas turbine engine structural member and fairing, the circumferential stop ring comprising:

an annular ring body for joining to the structural member;

a plurality of circumferential stop lugs projecting radially inward from the annular ring body for engaging the fairing; and a seal land projecting axially aftward from the annular ring body to provide a seal surface; and a plurality of bolt holes extending through the annular ring body, wherein the seal land is positioned radially outward of the plurality of bolt holes.

11. A gas turbine engine structural system comprising:

a frame comprising:

an outer ring;

an inner ring; and a plurality of struts joining the outer ring and the inner ring;

a fairing coupled to the plurality of struts between the outer ring and the inner ring;

a circumferential stop ring joined to the outer ring at a bolted connection and engaged with the fairing, the circumferential stop ring including a seal land that projects axially aftward from the circumferential stop ring radially outward of the bolted connection; and a seal extending between the fairing and the seal land.

12. The turbine seal system of claim 11 wherein the seal comprises:

a first end coupled to the fairing; and a second end secured between the seal land and the outer ring.

13. A turbine seal system comprising:

an annular structural frame;

a circumferential ring joined to the annular structural frame, the circumferential ring comprising:

an annular ring body engaged with the annular structural frame;

a circumferential stop projecting radially from the annular ring body; and a seal land projecting axially from the annular ring body;

a fairing disposed within the annular structural frame and engaged with the circumferential stop to limit circumferential rotation of the fairing with respect to the annular structural frame; and a first seal extending between the fairing and the circumferential ring to engage the seal land, the first seal comprising:

a first end coupled to the fairing; and a second end biased against the seal land; and a second seal comprising:

a first end coupled to the annular ring body; and a second end extending aftward so as to be configured to engage a structural component joined to the annular structural frame.

14. The turbine seal system of claim 13, wherein the circumferential stop ring is joined to the outer ring at a bolted connection.

15. The gas turbine engine structural system of claim 14 wherein the seal land projects axially aftward from the circumferential stop ring radially inward of the bolted connection.

* * * * *